US007731514B2

(12) United States Patent
Hughes et al.

(10) Patent No.: US 7,731,514 B2
(45) Date of Patent: Jun. 8, 2010

(54) ACTUATING DEVICE FOR SEPARABLE CONNECTOR SYSTEM

(75) Inventors: David Charles Hughes, Rubicon, WI (US); Brian Todd Steinbrecher, Brookfield, WI (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 12/274,816

(22) Filed: Nov. 20, 2008

(65) Prior Publication Data

US 2009/0088014 A1 Apr. 2, 2009

Related U.S. Application Data

(63) Continuation of application No. 12/126,266, filed on May 23, 2008, which is a continuation of application No. 11/199,051, filed on Aug. 8, 2005, now Pat. No. 7,384,287.

(51) Int. Cl.
*H01R 13/53* (2006.01)

(52) U.S. Cl. ..... 439/181

(58) Field of Classification Search ..... 439/181, 439/187, 921, 693, 886, 89, 158, 188, 184, 439/801, 206, 843, 157, 784, 480, 160
See application file for complete search history.

(56) References Cited

U.S. PATENT DOCUMENTS

| | | | | |
|---|---|---|---|---|
| 4,029,380 | A * | 6/1977 | Yonkers | 439/95 |
| 4,340,790 | A * | 7/1982 | Boliver | 218/150 |
| 5,427,538 | A * | 6/1995 | Knapp et al. | 439/157 |
| 5,857,862 | A * | 1/1999 | Muench et al. | 439/181 |
| 2002/0168887 | A1 * | 11/2002 | Roscizewski et al. | 439/206 |

* cited by examiner

*Primary Examiner*—Edwin A. Leon
(74) *Attorney, Agent, or Firm*—King & Spalding LLP

(57) ABSTRACT

A loadbreak connector system and methods for visible break include first and second mating connector assemblies configured to make or break an electrical connection under energized circuit conditions, the first and second mating connectors selectively positionable relative to one another. One of the first and second mating connectors includes an arc follower, and the other of the first and second mating connectors includes an arc interrupter. The arc interrupter is configured to receive the arc follower, and the first and second meting connectors are positionable in an disconnected position wherein the arc follower remains engaged to and is located within the arc interrupter. Arc energy is distributed among multiple locations to reduce arc intensity.

33 Claims, 8 Drawing Sheets

ACTUATING DEVICE FOR SEPARABLE CONNECTOR SYSTEM

RELATED PATENT APPLICATIONS

This patent application is a continuation of co-pending U.S. patent application Ser. No. 12/126,266, entitled "Apparatus, Systems and Methods for Deadfront Visible Loadbreak," filed May 23, 2008, which is a continuation of Ser. No. 11/199,051, filed Aug. 8, 2005, now U.S. Pat. No. 7,384,287, entitled "Apparatus, Systems and Methods for Deadfront Visible Loadbreak." The complete disclosure of each of the foregoing priority applications is hereby fully incorporated herein by reference.

BACKGROUND

The invention relates generally to separable loadbreak connector systems for electric power systems, aid more particularly to insulated loadbreak connector systems to interface deadfront electrical apparatus and power distribution cables. Electrical power is typically transmitted from substations through cables which interconnect other cables and electrical apparatus in a power distribution network. The cables are typically terminated on bushings that may pass through walls of metal encased equipment such as capacitors, transformers or switchgear.

Because of increased safety, increased reliability and increased operability of the deadfront system, deadfront electrical apparatus is increasingly being used in lieu of livefront apparatus. Using a deadfront system, because there is no exposed voltage, safety is increased for both the operator and the public, and the ability to operate the apparatus easily and efficiently either with grounded, visible break connection points or loadbreak connection points with a one or two man crew lessens the operating danger. The deadfront system has proven to be extremely reliable with very low failure rate.

Various safety codes and operating procedures for underground power systems require a visible break disconnect for safely performing routine maintenance work on the cable system, such as line energization checks, grounding, fault location, or hi-potting, may also be required. High voltage, separable connector systems have been developed that allow disconnection of the electrical path from a deadfront apparatus to the feeder cables connected to the apparatus bushings without moving the feeder cables and while providing visible-break isolation. Connector systems are known including a removable link or positionable connector assembly extending between a deadfront junction mounted to the electrical apparatus proximate the bushing of the apparatus and a mating connector joined to a cable. When the linking assembly is removed and the connector assembly is repositioned, the visible link is immediately recognizable. While such connector systems for deadfront apparatus can be effective to provide the visible break, they can be complicated to use, and generally require that the cables be de-energized prior to operation of the connectors. It would be desirable to provide a deadfront visible break that can be operated while the cables are energized, especially for medium voltage switchgear apparatus and the like.

Additionally, known separable loadbreak connectors are operable in "loadmake", "loadbreak", and "fault closure" conditions. Considerable arcing can occur in any of the operating conditions when energized connectors are joined and separated. It would be desirable to reduce arcing intensity as the connectors are mated and separated.

SUMMARY

According to an exemplary embodiment, an insulated, deadfront loadbreak connector system is provided. The system comprises first and second mating connector assemblies configured to make or break an electrical connection under energized circuit conditions, and the first and second mating connectors are selectively postionable relative to one another. One of the first and second mating connectors includes an arc follower, and the other of the first and second mating connectors includes an arc interrupter configured to receive the arc follower. The first and second mating connectors are positionable in a disconnected position wherein an end of the arc follower remains interior to the other of the first and second connectors.

According to another embodiment, an insulated, deadfront loadbreak connector system comprises first and second mating connector assemblies configured to make or break an electrical connection under energized circuit conditions. One of the first and second connector assemblies is stationary and the other of the first and second connector assemblies is movable, wherein one of the first and second connectors includes first and second substantially parallel interfaces connected by a bus, thereby distributing arc energy among at least two different locations during operation of the connectors.

According to another embodiment, an insulated, separable connector system comprises first and second mating connector assemblies configured to make or break an electrical connection to a deadfront electrical apparatus under energized circuit conditions. One of the first and second connector assemblies is stationary and the other of the first and second connector assemblies is movable. One of the mating connector assemblies comprising a contact element configured to make and break one of an energized connection under a normal load current and an energized connection that is not under a normal load current. At least one of an actuating element to engage or disengage the mating connector assemblies and a slidable positioning element configured to align the mating connector assemblies is also provided.

According to another embodiment, a method of visibly breaking an electrical connection to a deadfront electrical apparatus is provided. The method comprises providing first and second electrical connectors, one of the connectors being fixed to the apparatus and the other of the connectors movable thereto, and one of the connectors including an arc follower and the other of the connectors including an arc interrupter. The method also includes joining the first and second electrical connectors under energized circuit conditions to complete the electrical connection to the apparatus, separating the first and second electrical connectors to disconnect the electrical connection to the apparatus, and limiting the separation of the first and second electrical connectors so that the arc follower remains within the arc interrupter and arc energy substantially remains in an interior of the connectors.

According to another embodiment, a method of visibly breaking an electrical connection to a deadfront electrical apparatus is provided. The method comprises providing first and second electrical connector assemblies, at least one of the connectors having first and second contact elements connected to a bus, thereby providing a series connection between the first and second contact elements. The method also includes joining the first and second electrical connectors under energized circuit conditions to complete the electrical connection to the apparatus, and simultaneously breaking electrical arcing at the first and second contact element.

According to still another exemplary embodiment, a separable loadbreak connector system comprises means for completing and breaking an electrical connection under energized circuit conditions and means for distributing arc energy, connected to the means for completing and breaking, at more than one location. Means for positioning the means for completing and breaking to complete and break the electrical connection are also provided.

DETAILED DESCRIPTION OF EXEMPLARY EMBODIMENTS

Figure 1:
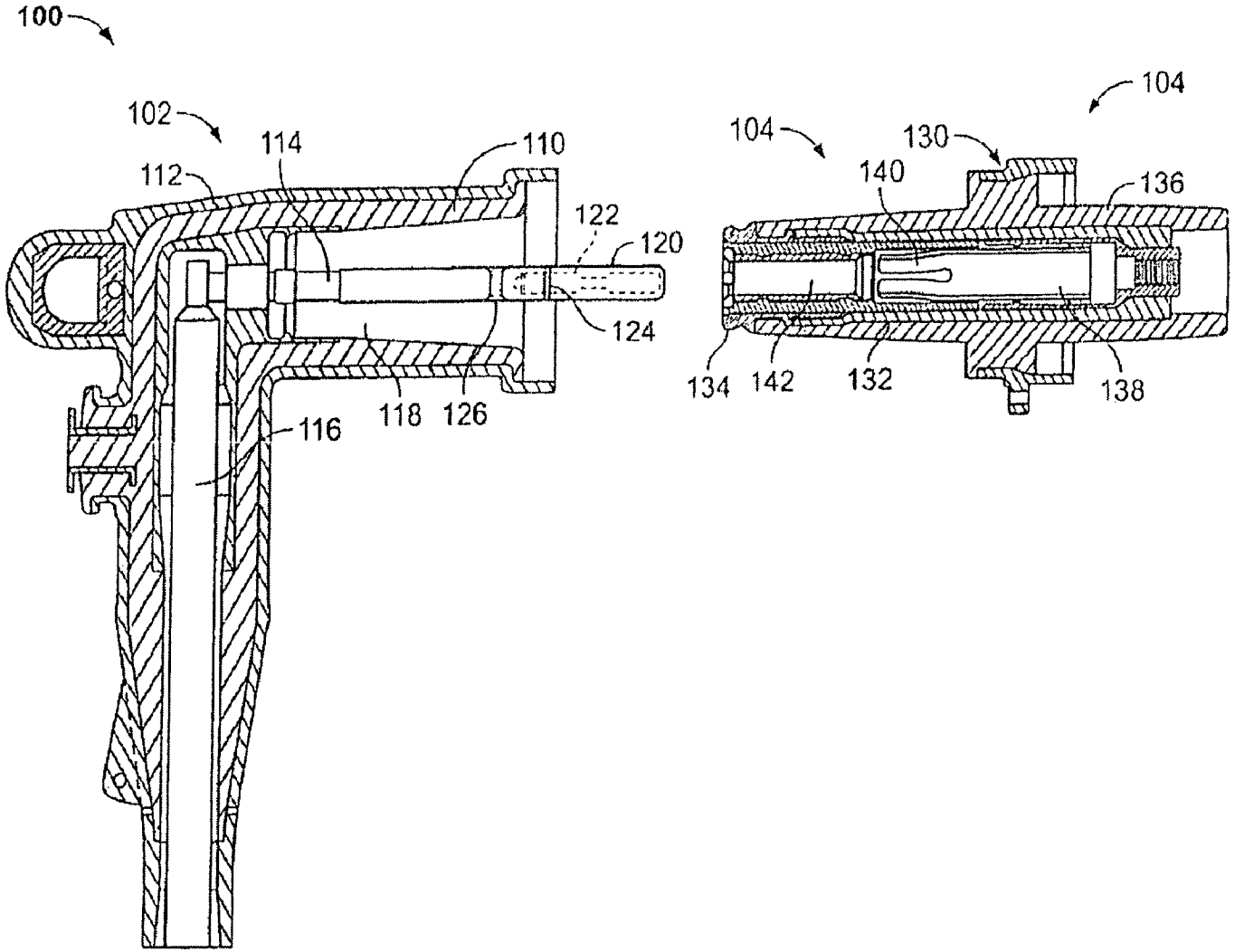
FIG. 1 is a longitudinal cross-sectional view of a known separable loadbreak connector system.

FIG. 1 is a longitudinal cross-sectional view of a separable loadbreak connector system 100, the type of which may be employed in an assembly according to the present invention.

As shown in FIG. 1, the system 100 includes a female connector 102 and a male connector 104 for making or breaking an energized connection in a power distribution network. The male connector 104 may be, for example, a bushing insert or connector connected to a deadfront electrical apparatus such as a capacitor, a transformer, switchgear or other electrical apparatus for connection to the power distribution network, and the female connector 102, may be, for example, an elbow connector, electrically connected to a power distribution network via a cable (not shown). The female and male connectors 102, 104 respectively engage and disengage one another to achieve electrical connection or disconnection to and from the power distribution network.

While the female connector 102 is illustrated as an elbow connector in FIG. 1, and while the male connector 104 is illustrated as a bushing insert, it is contemplated that the male and female connectors may be of other types and configurations in other embodiments. The description and figures set forth herein are set forth for illustrative purposes only, and the illustrated embodiments are but one exemplary configuration embodying the inventive concepts of the present invention.

In an exemplary embodiment, and as shown in FIG. 1, the female connector 102 may include an elastomeric housing 110 of a material such as EPDM (ethylene-propylene-dienemonomer) rubber which is provided on its outer surface with a conductive shield layer 112 which is connected to electrical ground. One end of a male contact element or probe 114, of a material such as copper, extends from a conductor contact 116 within the housing 110 into a cup shaped recess 118 of the housing 110. An arc follower 120 of ablative material, such as acetal co-polymer resin loaded with finely divided melanine in one example, extends from an opposite end of the male contact element 114. The ablative material may be injection molded on an epoxy bonded glass fiber reinforcing pin 122. A recess 124 is provided at the junction between metal rod 114 and arc follower 120. An aperture 126 is provided through the exposed end of male contact element 114 for the purpose of assembly.

The male connector 104 may be a bushing insert composed of a shield assembly 130 having an elongated body including an inner rigid, metallic, electrically conductive sleeve or contact tube 132 having a non-conductive nose piece 134 secured to one end of the contact tube 132, and elastomeric insulating material 136 surrounding and bonded to the outer surface of the contact tube 132 and a portion of the nose piece 134.

A contact assembly including 102, a female contact 138 having deflectable contact fingers 140 is positioned within the contact tube 132, and an arc interrupter 142 is provided proximate the female contact 138.

The female and male connectors 102, 104 are operable or matable during "loadmake", "loadbreak", and "fault closure" conditions. Loadmake conditions occur when the one of the contact elements, such as the male contact element 114 is energized and the other of the contact elements, such as the female contact element 138 is engaged with a normal load. An arc of moderate intensity is struck between the contact elements 114, 138 as they approach one another and until joinder under loadmake conditions. Loadbreak conditions occur when the mated male and female contact elements 114, 138 are separated when energized and supplying power to a normal load. Moderate intensity arcing again occurs between the contact elements 114, 138 from the point of separation thereof until they are somewhat removed from one another. Fault closure conditions occur when the male and female contact elements 114, 138 are mated with one of the contacts being energized and the other being engaged with a load having a fault, such as a short circuit condition. Substantial arcing occurs between the contact elements 114, 138 in fault closure conditions as the contact elements approach one another they are joined. In accordance with known connectors, arc-quenching gas is employed to accelerate the female contact 138 in the direction of the male contact element 114 as the connectors 102, 104 are engaged, thus minimizing arcing time and hazardous conditions. The arc interrupter 142 is sized and dimensioned to receive the arc follower 120. The arc interrupter 142 generates arc-quenching gas to extinguish arcing when the probe 114 is separated from the female contact 138.

Figure 2:
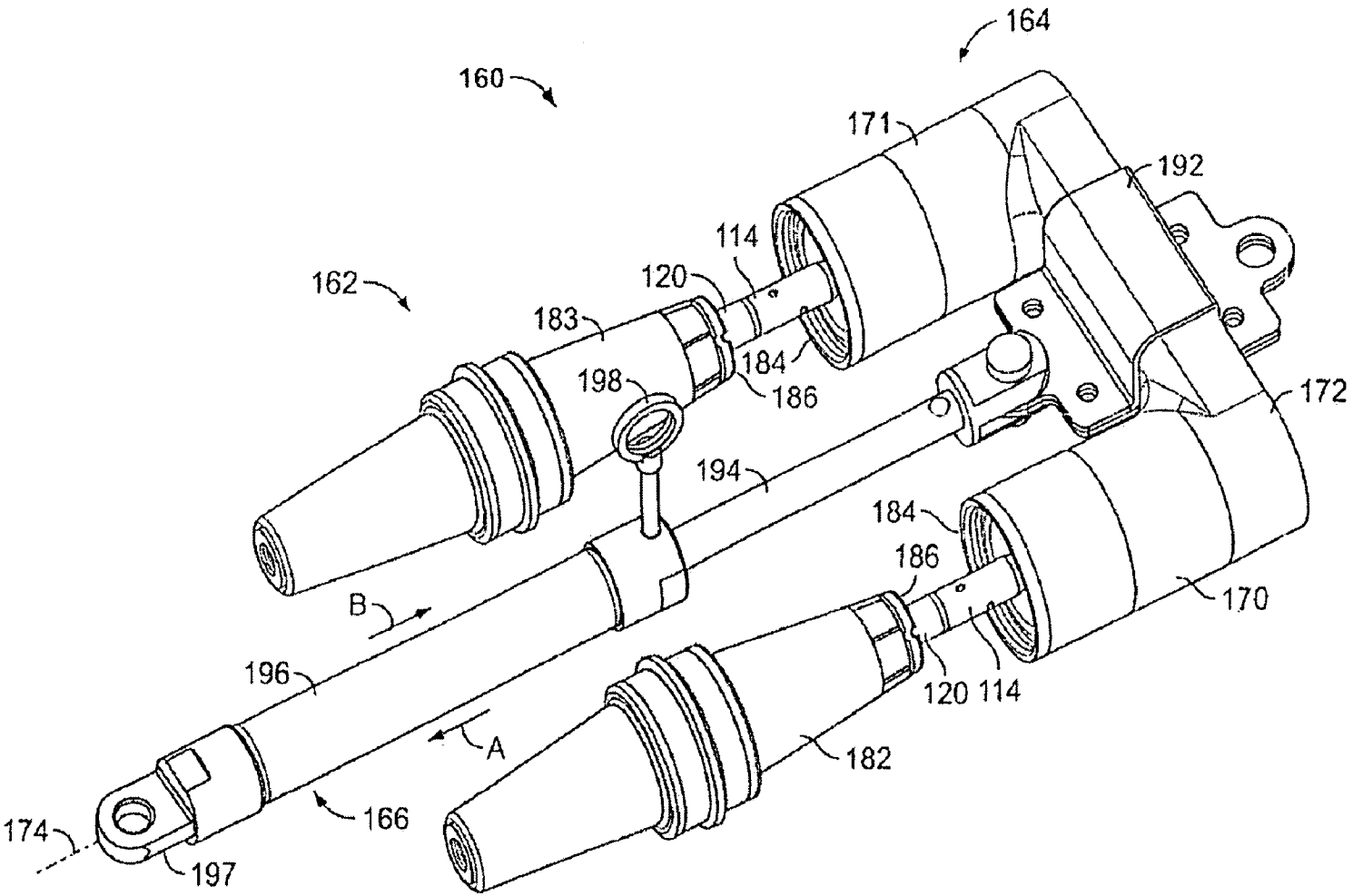
FIG. 2 is a perspective view of a parallel interface loadbreak connector assembly according to the present invention.

FIG. 2 is a perspective view of a parallel interface loadbreak connector system 160 according to the present invention that may be used to interface, for example, a deadfront electrical apparatus with power cables while providing an easy to use, visible break connector system with reduced arcing intensity during operation thereof explained below. The system 160 includes a fixed connector assembly 162, and a movable connector assembly 164 that is selectively positionable with respect to the fixed connector assembly 162 via a positioning mechanism 166.

In an exemplary embodiment, the movable connector assembly 164 includes ganged female connectors 170, 171 that may be, for example, similar to the female elbow connector 102 illustrated in FIG. 1. The connectors 170, 171 are joined to one another by a connecting housing 172 and are electrically interconnected in series via a bus (not shown in FIG. 2 but described below). The connectors 170, 171 are substantially aligned in parallel with one another on opposite sides of a central longitudinal axis 174 of the system 160. As such, the probes 114 and arc followers 120 of the female connectors 170 and 171 are aligned in parallel fashion about the axis 174.

The fixed connector assembly 162, in an exemplary embodiment includes stationary male connectors 182, 183 that correspond to and are aligned with the female connectors 170, 171. The male connectors 182, 183 may each be, for example, similar to the male connector 104 shown in FIG. 1. In an exemplary embodiment, the connector 182 may be connected to a vacuum switch or interrupter assembly (not shown) that is part of the deadfront electrical apparatus, and the connector 183 may be connected to a power cable in a known manner, with or without additional bushings and connectors as those in the art may appreciate.

The male connectors 182, 183 may be mounted in a stationary manner to a mounting plate (not shown in FIG. 1) that may be a part of the deadfront electrical apparatus or a separately provided mounting structure that maintains the male connectors 182, 183 in a fixed position. The male connectors 182, 183 are maintained in a spaced apart manner aligned with the female connectors 170, 171 such that, when the female connectors 170, 171 are moved along the assembly longitudinal axis 174 in the direction of arrow A, the male connectors 182, 183 may be securely engaged to the respective female connectors 170, 171. Likewise, when the female connectors 170, 171 are moved in the direction of arrow B, opposite to the direction of arrow A, the female connectors 170, 171 may be disengaged from the respective male connectors 182, 183 to a separated position as illustrated in FIG. 2.

In the separated position, the mating interfaces 184 of the female connectors 170, 171 and mating interfaces 186 of the male connectors 182, 183 are accessible for service and repair. The position of the movable connector assembly 164 in relation to the fixed connector assembly 162 provides a visible break to verify disconnection of the cable associated with the connector 183 from, for example, a deadfront electrical apparatus.

A positioning/actuating mechanism 166 is fastened to a central portion of the connector housing 172 and is attached thereto with an adapter plate 192 and known fasteners. In use, the mechanism 166 is configured to cause the connector assembly 164 to move away from the male connectors 182, 183 in the direction of arrow B. In an exemplary embodiment, the mechanism 166 is a stored energy device having concentric telescoping members 194, 196 slidably engaged to one another and positionable in a retracted position (shown in FIG. 4) wherein the female connectors 170, 171 are engaged to the male connectors 182, 183 and an extended position illustrated in FIG. 2 wherein the female connectors 170, 171 are electrically disconnected from the male connectors 182, 183, but remain mechanically engaged as described below. An end 197 of the telescoping member 196 may be mounted in a stationary manner if a fixed position relative to the male connectors 182, 183 so that as the mechanism 166 is moved between the extended and retracted positions, the connector assembly 164 is likewise moved relative to the male connectors 182, 183.

Figure 3:
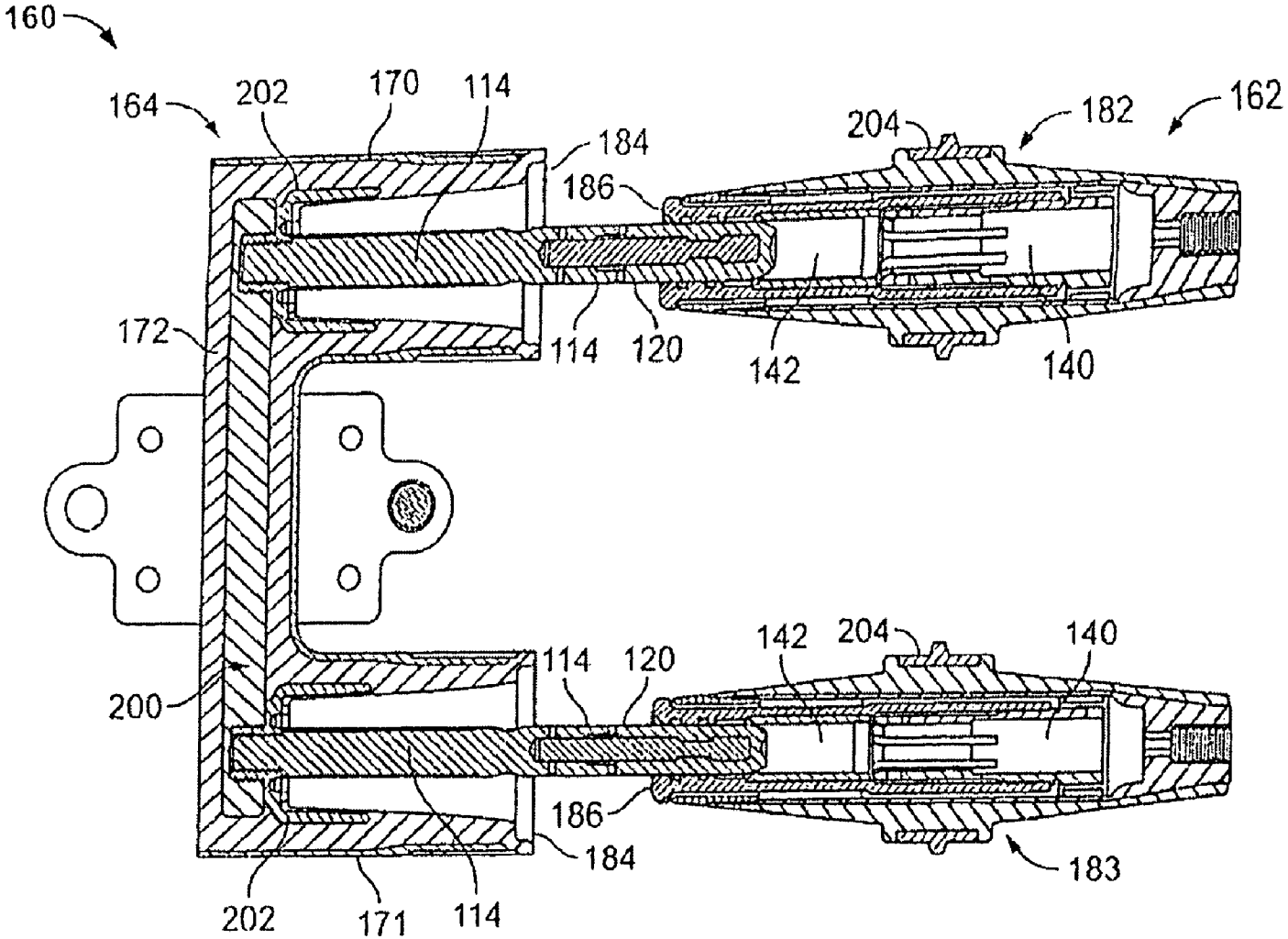
FIG. 3 is a sectional view of a portion of the assembly shown in FIG. 2.

In an exemplary embodiment, an actuating or release element, internal to the mechanism 166, may be mounted to one or more of the telescoping members to bias the telescoping members in the direction of arrow B. Stop features, such as pins or detents, may be provided so that the telescoping members 194, 196 may be extended to, but not beyond a predetermined distance in the extended position. The stop features may be chosen so that the arc followers 120 of the female connectors 170, 171 remain partially engaged to the male connectors 182, 183 in a disconnected position wherein the conductive path between the male and female connectors is broken, while a portion of the arc followers 120 remain in the arc interrupters 142 interior to the male connectors 182, 183 in a as shown in FIG. 3.

In an exemplary embodiment, the release element may be a compressible spring element that is loaded in compression as the telescoping members 194, 196 are retracted, although it is understood that in an alternative embodiment, the release element could be loaded in tension. Once released, the force stored in the spring actuates or extends the telescoping members 194, 196 to the extended position wherein the connector assembly 164 is moved in the direction of arrow B for a sufficient distance to disengage or disconnect a conductive path through the male and female contacts, but an insufficient distance to mechanically separate the arc followers 120 from the arc interrupters 142 of the male connectors 182, 183. That is, the release distance is selected to keep the arc follower 120 at least partially contained within the arc interrupter 142 of each connector in the extended position. In one embodiment the telescoping members 194, 196 of the mechanism 166 are extended outwardly an axial distance of about 6.5 inches from the retracted position (FIG. 4) to the extended position. Once in the extended position, the telescoping members 194, 196 may be moved back against the bias of the release element to the retracted position to reset the mechanism 166 so that the mechanism 166 is again ready for use. In alternative embodiments, other stored energy release elements could be used in lieu of springs to provide assisted disconnection of the connector assembly 164 from associated male connectors 182, 183 in use.

Figure 4:
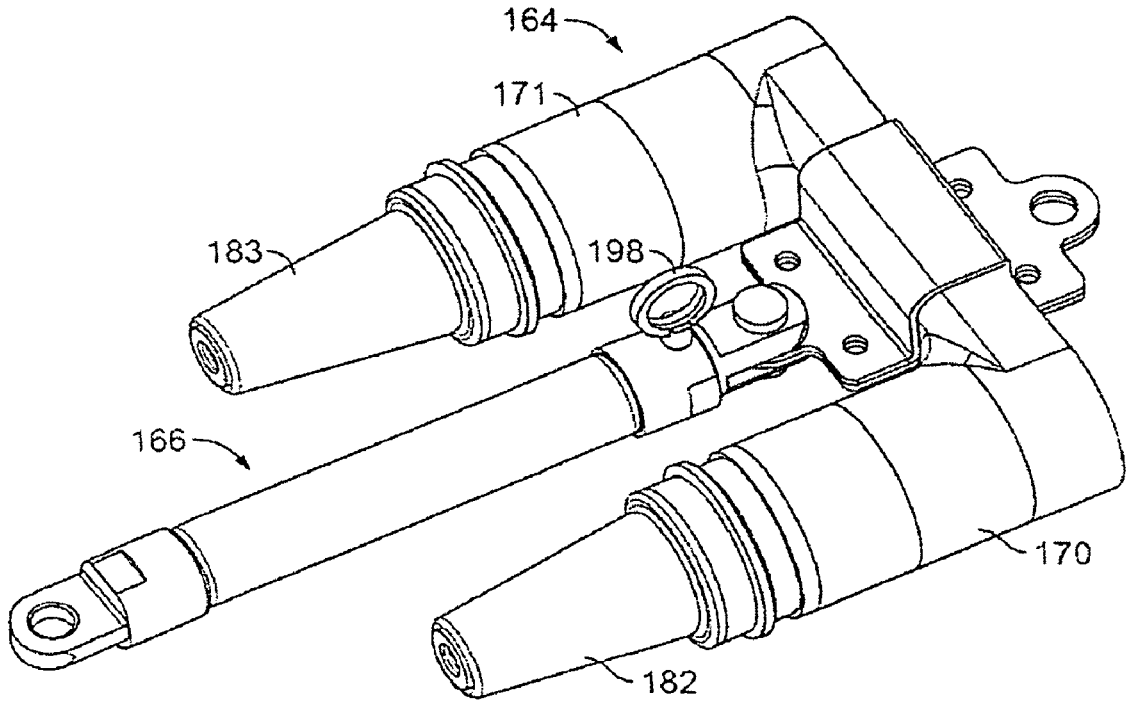
FIG. 4 illustrates the assembly shown in FIG. 2 in one operating position.

In an exemplary embodiment, and as shown in FIGS. 2 and 4, a release pin 198 is provided to maintain the mechanism 166 in the retracted position. To open or operate the mechanism 166 to the extended position and disconnect the connector assembly 164 from the male connectors 182, 183, the pin 198 may be released, thereby releasing the biased actuator element in the mechanism 166 to move the connector assembly 164 to the extended position, sometimes referred to herein as a safe break disconnected position. The mechanism 166 facilitates rapid connection or disconnection of energized components of the connector system 160, thereby minimizing a duration of electrical arcing that occurs when the energized connectors are engaged and/or disengaged. Further, because the arc followers 120 remain mechanically engaged to the arc interrupters 142 with the ends of the arc followers 120 located interior to the female connectors 170, 171, and more specifically interior to the arc interrupters 142, substantially all of the arc energy is contained interior to the connectors and away from nearby personnel when the connectors are operated. Safe and reliable actuation is therefore provided at relatively low cost.

Additionally, after initial alignment of the connector assembly 164 with the male connectors 182, 183, the connector assembly 164 is maintained in alignment by virtue of the arc followers 120 never completely separating from the male connectors 182, 183 in use. Thus, an external alignment mechanism, is not needed to safely align and operate the male and female connectors. The mechanism 166 both maintains the alignment of the connectors and actuates them to the disconnected position when released.

While an exemplary positioning/actuating mechanism 166 is illustrated in FIGS. 2-4 to facilitate and/or ensure a proper alignment of the connectors 170, 171 and 182, 183, as well as to actuate or move the connectors to one another, it is understood that other positioning elements and actuation mechanisms could be employed in lieu of the mechanism 166 thus far described, and separate positioning and actuating elements and/or mechanisms could be employed in combination in the system 160. Further, in some embodiments, the mechanism 166 could be entirely omitted in another embodiment wherein the connectors are manually aligned, engaged and disengaged by an operator using for example, a hotstick.

In further and/or alternative embodiments, other actuating elements may be provided to engage or disengage the movable connector assembly 164 to and from the fixed connector assembly 162. The actuating element may be for example, a motorized mechanism, a hydraulic mechanism, a pneumatic mechanism, a draw-out mechanism, or other known device that is operatively connected to the assembly 164 to engage or disengage the assembly connectors 170, 171 and 182, 183. The actuating element may provide for remote actuation of the system 160 as desired, and may also prevent or limit movement of the connector assembly 164 relative to the connector assembly 162. Additionally, other positioning elements may be provided such as, for example, rails upon which the connectors may slide relative to one another while assuring proper alignment of the connectors in the system.

FIG. 3 is a sectional view of a portion of the ganged connector assembly 164 and the female connectors 170 and 171. As seen in FIG. 3, the connector assembly 164 is formed with the insulated connector housings 170 and 171 joined by the connector housing 172. A bus 200 interconnects contact probes 114 in the respective housings 170 and 171. Adapters 202 are provided that receive one end of the respective probes 114 with threaded engagement, and the adapters 202 are, in turn, threadedly engaged to corresponding openings in the end of the bus 200. In an alternative embodiment, the adapters 202 are optional.

EPDM rubber insulation, for example, may surround the conductive bus 200, the adapters 202, and may define the interfaces 184 that receive the male connectors 181, 183. Ground shields 204 may be provided on the outer surfaces of the housings 170, 171, and the connector housing 172 as desired.

While the assembly 164 is formed into a U-shaped configuration having substantially equal legs in one embodiment as shown in FIGS. 2-4, it is appreciated that the connector assembly 164 may be alternatively shaped in other embodiments while still providing the load breaking functionality of the present invention. For example, the housings 170, 171 may be unequal in size, shape and dimension such as length, and the housings 170, 171 need not extend from the bus 200 at right angles in other embodiments.

Notably, and unlike known connector systems, the connector assembly 164 permits load breaking and load making with reduced arc intensity. By connecting the probes 114 in series to one another via the bus 200, the electrical making and breaking is distributed among multiple locations rather than in a single location. That is, because of the series connection provided by the bus 200, the arcs occur at the ends of each probe 114 rather than solely at the end of a single probe. By distributing the arc along two locations, a reduced arc intensity is seen at each probe in the interfaces 184. By reducing the arc intensity, the connector system 160 is generally safer to use than known systems. This is especially so when the system 160 is used in the manner shown in FIGS. 2 and 3.

FIGS. 2 and 3 illustrate the system 160 in a disconnected safe break operating position wherein the movable connector assembly 164 is adjacent the stationary connector assembly 162, but the mating interfaces 184, 186 are not completely separated from one another. Consequently, and as best seen in FIG. 3, the ends of the arc followers 120 of the female connectors 170, 171 remain within the arc interrupter housing 142 of the male connectors 182, 183, but the contact probes 114 arc separated from the female contacts 140 and the conductive path between the respective connectors 170 and 182 and 171 and 183 is opened. Electrical arcing is interrupted by the production of arc quenching gas generated in the arc interrupters 142, and as the gas pressure builds, the compressed gas becomes a dielectric to prevent further generation of the electrical arcs. Additionally, because the connector interfaces 184, 186 are not completely separated, electrical arcing is maintained at a location interior to the connector interfaces, and is directed away from personnel as the connectors are separated. Thus, safety of the connector system 160 is increased relative to known practices wherein the mating interfaces of connectors are completely separated, creating the opportunity for electrical arcing exterior to the connectors 170, 171 and 182, 183 as they are joined and separated.

While the exemplary method of safe break disconnection is described in the context of the ranged connector assembly 164, it is appreciated that the method could be practiced in systems having a single loadbreak location as well. That is, the method is believed to be advantageous for single male and female loadbreak connections under electrical load.

In an exemplary embodiment the connector assembly 164 is a 600 A, 21.1 kV class loadbreak connector for use with medium voltage switchgear or other electrical apparatus in a power distribution network of above 600V. It is appreciated, however, that the connector concepts described herein could be used in other types of connectors and in other types of distribution systems, such as high voltage systems, as desired.

Figure 5:
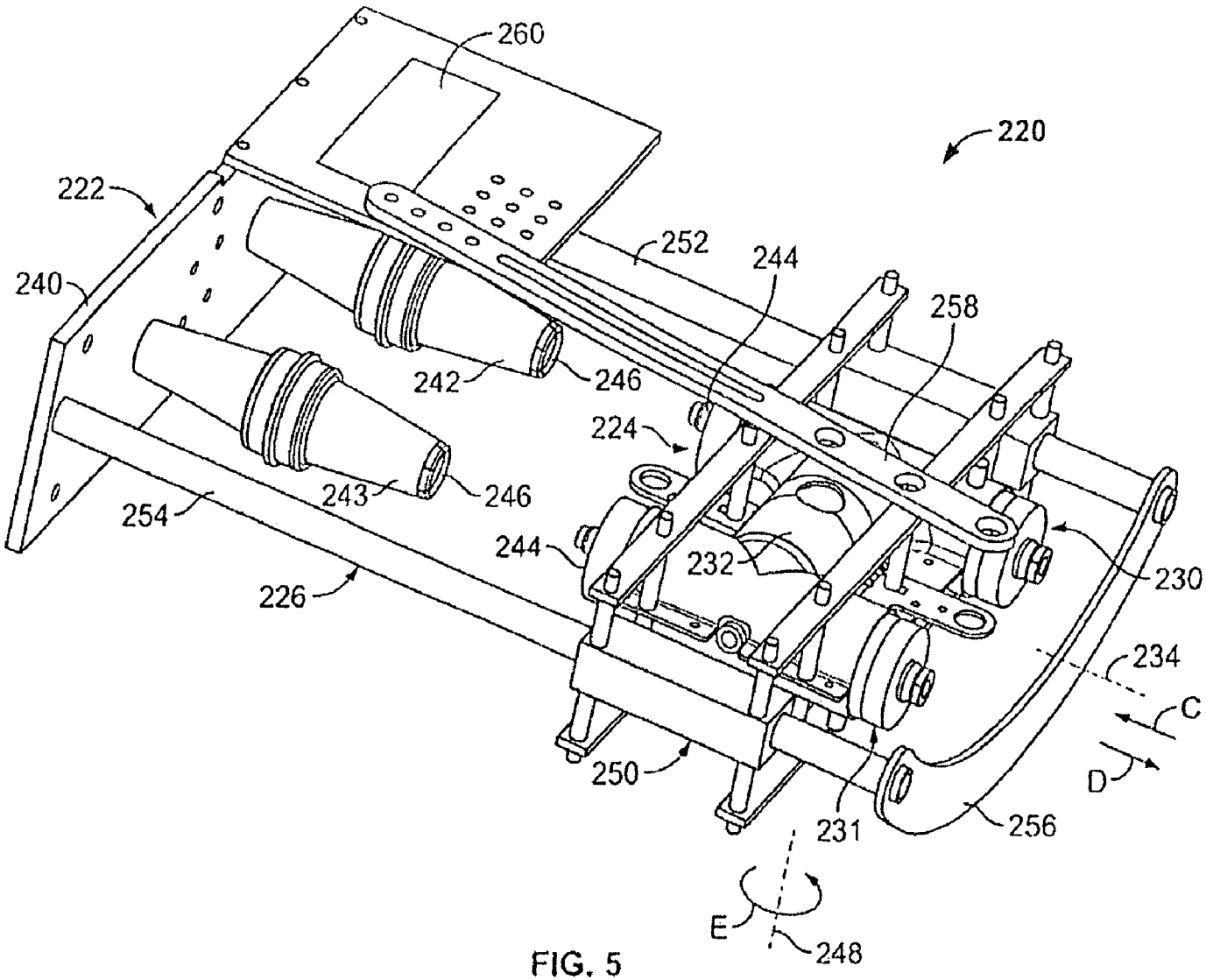
FIG. 5 is a perspective view of another embodiment of a loadbreak connector assembly according to the present invention.
Figure 6:
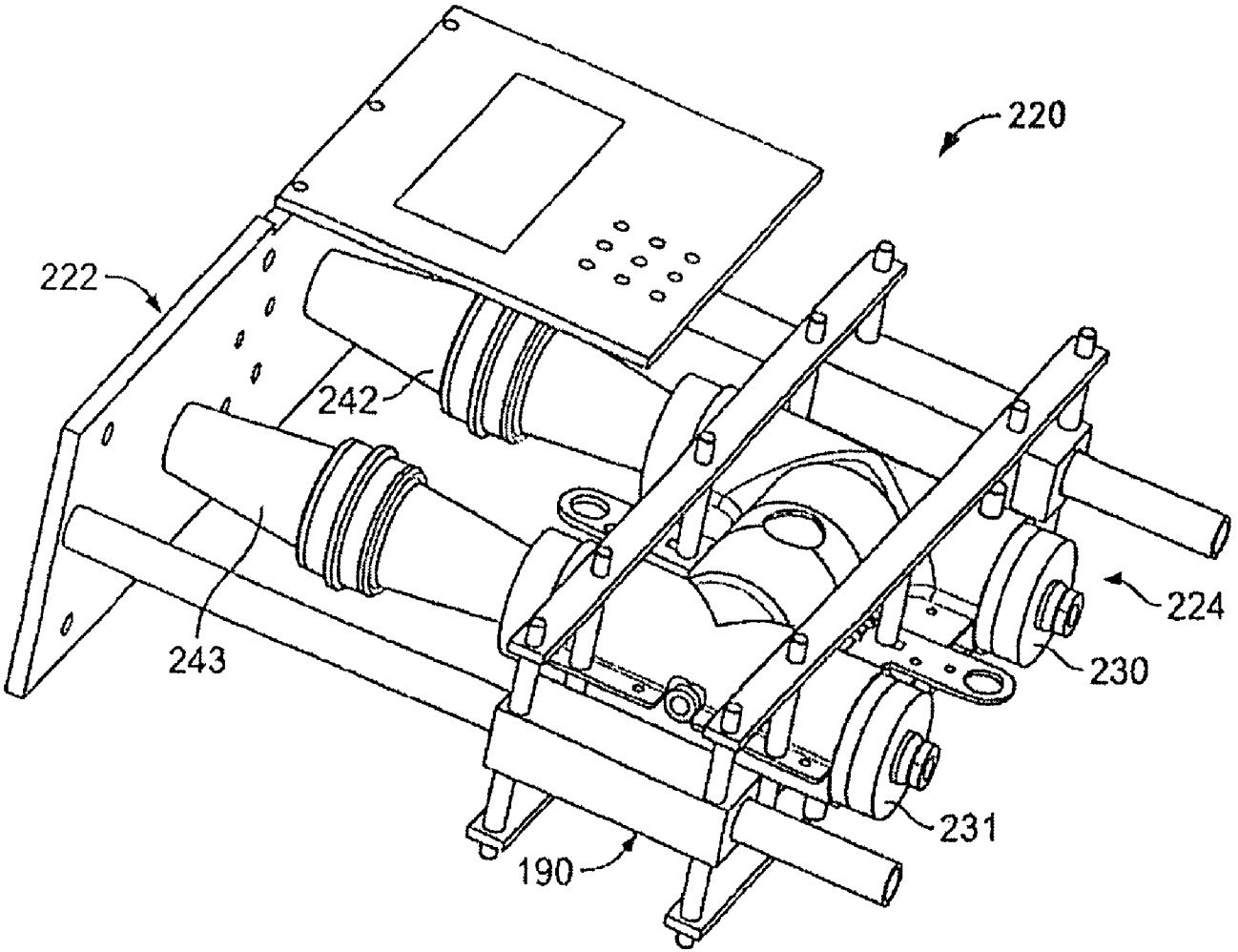
FIG. 6 illustrates the assembly shown in FIG. 5 in one operating position.

FIGS. 5 and 6 are perspective views of a another parallel interface loadbreak connector system 220 according to the present invention. The system 220 includes a fixed connector assembly 222, and a movable connector assembly 224 that is selectively positionable with respect to the fixed connector assembly 222 via a positioning mechanism 226.

In an exemplary embodiment, the movable connector assembly 224 includes ganged female connectors 230, 231 that may be, for example, similar to the connectors 170, 171 illustrated in FIGS. 2-4. The connectors 230, 231 are joined to one another by a connecting housing 232 and are electrically interconnected in series via a bus 233 (FIG. 7) similar to the bus 200 shown in FIG. 3 to connect the interfaces in series and distribute arc energy among more than one location as described above. The connectors 230, 231 are substantially aligned in parallel with one another on opposite sides of a central longitudinal axis 234 of the assembly 224. As such, the probes 114 and arc followers 120 (FIG. 7) of the female connectors 230 and 231 are aligned in parallel fashion about the axis 234. While the connector assembly 224 is illustrated in a U-shape or configuration, it is recognized that other shapes and configurations may be employed as desired.

The fixed connector assembly 222, in an exemplary embodiment, includes a mounting plate 240, and male connectors 242, 243 that correspond to and are aligned with the female connectors 230, 231, respectively. In an exemplary embodiment, the connector 242 may be connected to a vacuum switch or interrupter assembly (not shown) that is, for example, part of a deadfront electrical apparatus in a power distribution network, and the connector 243 may be connected to a power cable in a known manner, with or without additional bushings and connectors as those in the art may appreciate.

The mounting plate 240 secures the male connectors 242, 243 in a spaced apart manner aligned with the female connectors 230, 231 such that, when the female connectors 230, 231 are moved along the assembly longitudinal axis 234 in the direction of arrow C, the male connectors 242, 243 maybe securely engaged to the respective male connectors 230, 231. Likewise, when the female connectors 230, 231 are moved in the direction of arrow D, opposite to the direction of arrow C, the female connectors 230, 231 may be disengaged from the respective male connectors 242, 243 to a separated position as shown in FIG. 5. The end plate 240 may be a part of the electrical apparatus to which the connectors 242, 243 are attached, or may be a separately provided support structure for the connectors 242, 243.

In the separated position, the mating interfaces 244 of the female connectors 230, 231 and mating interfaces 246 of the male connectors 242, 243 are accessible for service and repair, in a further embodiment, a portion of the assembly 220 maybe pivotable about a pivot axis, such as the axis 248, to turn or rotate the female connectors 230, 231 relative to the male connectors 242, 243 in the direction of arrow E to provide even greater accessibility to the connector interfaces 244 and 246. The position of the movable connector assembly 224 in relation to the fixed connector assembly 222 provides a visible break to verify disconnection of the cable associated with the connector 243 from the deadfront electrical apparatus.

The positioning mechanism 226 may be, as shown in FIG. 5, a sliding mechanism including a carriage assembly 250 fixed to the movable connector assembly 224, and rails 252, 254 slidably received within the carriage assembly 250 on respective sides of the stationary connector assembly 222. The rails 252, 254 are each connected to the mounting plate 240 on one end, and an alignment member 256 on the opposite end. The alignment member 256 maintains a proper separation of the rails 252, 254 at one end, and the mounting plate 240 maintains the proper separation of the rails 252, 254 at the other end. The rails 252, 254 pass through bores or openings in the carriage assembly 250 so that carriage assembly 250 may be passed over the rails 252, 254 in the directions of arrows C and D to engage or disengage the movable connector assembly 224 from the stationary connector assembly 222. The alignment member 256 may be curved or bowed away from the movable connector assembly 224 as shown in FIG. 5 to provide a clearance for the connectors 230, 231 as they are moved toward the alignment member 256 on the rails 252, 254. A stop bar 258 may be provided to limit or prevent separation of the movable connector assembly 224 from the stationary connector assembly 222 beyond a predetermined amount.

In a further embodiment, an actuating element 260 may be provided to engage or disengage the movable connector assembly 224 to and from the fixed connector assembly 222. The actuating element 260 may be for example, a motorized mechanism, a hydraulic mechanism, a pneumatic mechanism, a draw-out mechanism, or other known device that is operatively connected to the assembly 224 to engage or disengage the assembly connectors. The actuating element 260 may provide for remote actuation of the system 220 as desired, and may also prevent or limit movement of the connector assembly 224 relative to the connector assembly 222. Still further, the actuating element 260 may be a stored energy device, such as a spring assisted mechanism or other known mechanism, that facilitates rapid connection or disconnection of energized components of the connector system, thereby minimizing a duration of electrical arcing that occurs when the energized connectors are engaged and/or disengaged.

While an exemplary positioning mechanism 226 in the form of rails 252, 254 and associated components is illustrated in FIG. 5 to facilitate and/or ensure a proper alignment of the connectors 230, 231 and 242, 243, it is understood that other positioning elements and mechanisms could be employed in lieu of the rail system and carriage assembly thus far described. Further, in some embodiments, the positioning mechanism is considered to be entirely optional. Likewise, it is understood that the actuating element 260 could be entirely omitted in another embodiment wherein the connectors are manually engaged and disengaged using for example, a hot-stick.

FIG. 6 illustrates the system 220 shown in FIG. 5 in an intermediate operating position wherein the movable connector assembly 224 and the stationary connector assembly 222 are partially engaged to one another as the assembly 224 is moved in the direction of arrow C (FIG. 5).

Figure 7:
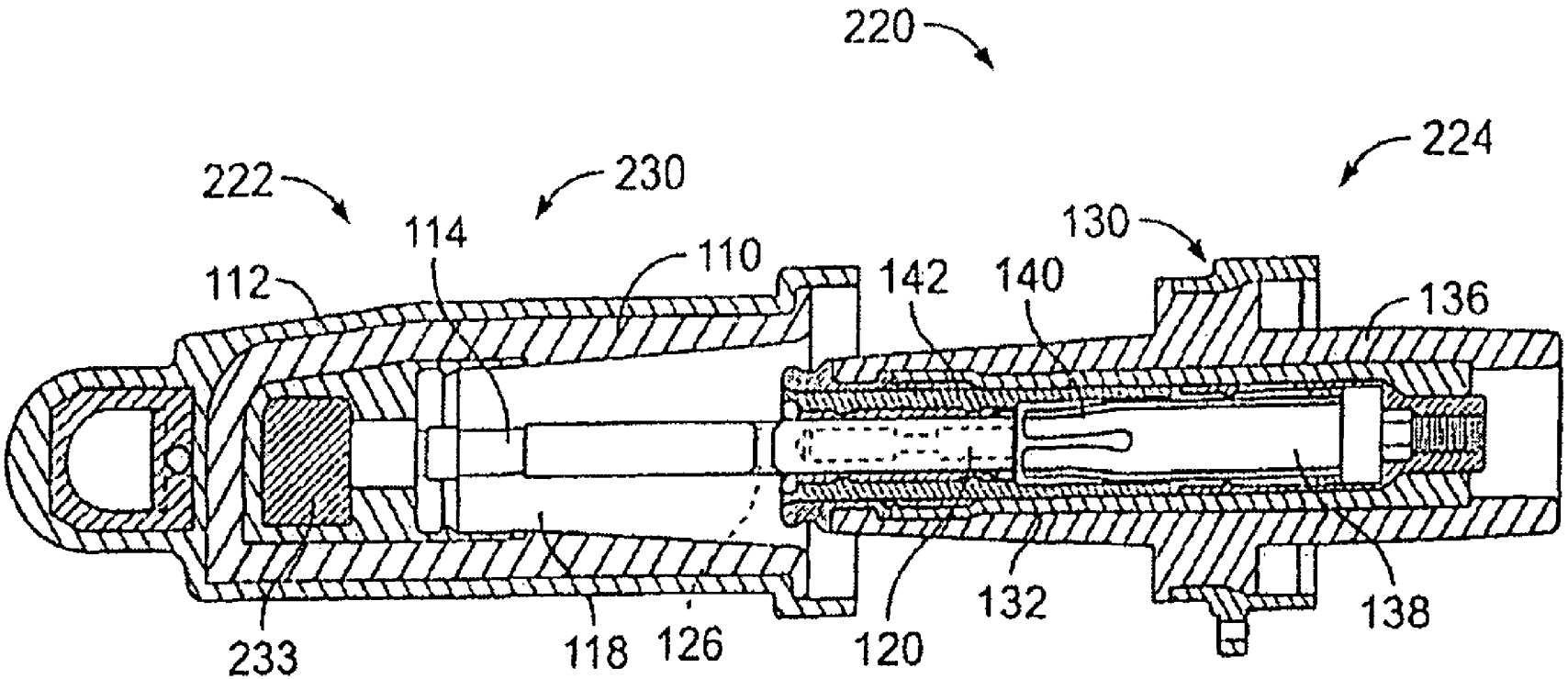
FIG. 7 is a longitudinal cross-sectional view of the separable loadbreak connector assembly shown in FIGS. 5 and 6 in one operating position.

Like the foregoing system 160, and as best seen in FIG. 7, the assembly 224 is positionable relative to the assembly 222 in a safe break disconnect position wherein the arc followers 120 of the female connectors 230, 231 remain within the arc interrupters 142 of the male connectors 242, 243, but the contact probes 114 are separated from the female contact element 138 and the conductive path between the connectors 102, 104 is opened. Electrical arcing is interrupted by the production of arc quenching gas generated in the arc interrupters 142, and as the gas pressure builds, the compressed gas becomes a dielectric to prevent further generation of the electrical arcs. Additionally, because the connector interfaces are not completely separated, electrical arcing is maintained at a location interior to the connector interfaces, and is directed away from personnel as the connectors are separated. Thus, safety of the connector system 220 is increased relative to known practices wherein the mating interfaces of connectors are completely separated, creating the opportunity for electrical arcing exterior to the connectors as they are joined and separated.

While the exemplary method of safe break disconnection is described in the context of the ganged connector assembly 224, it is appreciated that the method could be practiced in systems having a single loadbreak location as well. That is, the method is believed to be advantageous for single male and female loadbreak connections under electrical load.

In an exemplary embodiment the connector assembly 224 is a 200 A, 25 kV class loadbreak connector for use with medium voltage switchgear or other electrical apparatus in a power distribution network of above 600V. It is appreciated, however, that the connector concepts described herein could be used in other types of connectors and in other types of distribution systems, such as high voltage systems, as desired.

The combination of distributed arc energy among more than one location, together with the above-described safe break positions wherein the electrical path is disconnected while containing substantially all of the arc energy interior to the connectors, results in safer and more reliable loadbreak connector systems with visible break for deadfront electrical apparatus.

Figure 8:
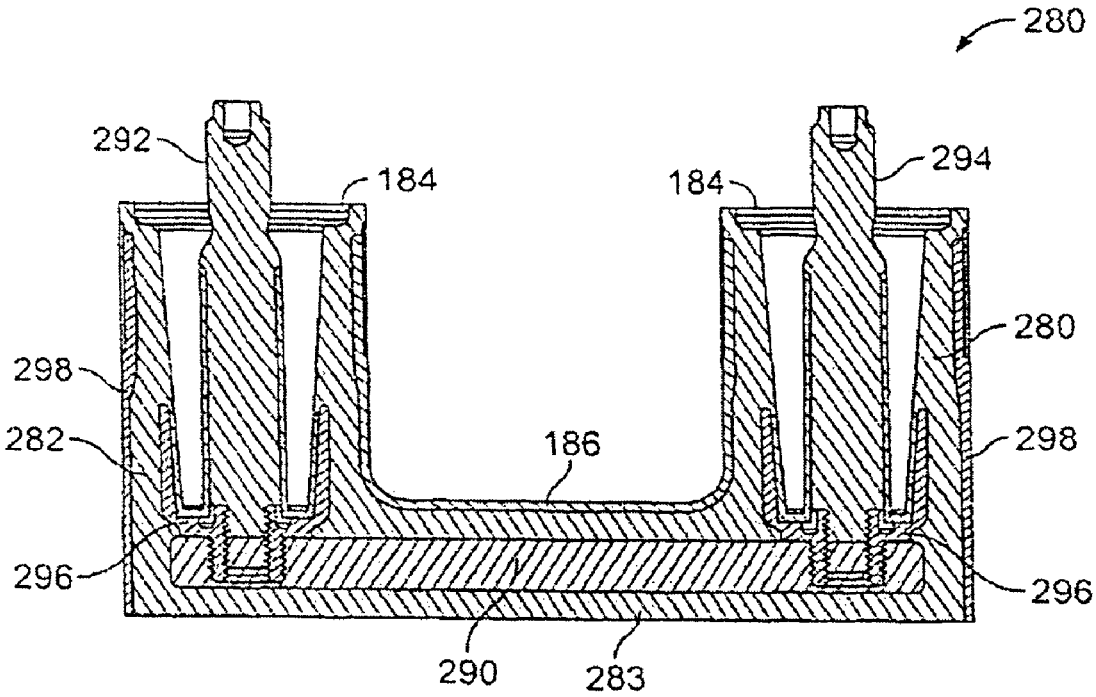
FIG. 8 is a sectional view of a portion of another embodiment of a connector assembly in accordance with the present invention.

FIG. 8 is a sectional view of a portion of another ganged connector assembly 280 according to the present invention that may be used in, for example, the above described systems 160 and 220. As seen in FIG. 7, the connector assembly 280 is formed with the insulated connector housings 281 and 282 joined by a connector housing 283. A bus 290 interconnects contact probes 292, 294 in the respective housings 281 and 282. Adapters 296 are provided that receive one end of the respective probes 292, 294 with threaded engagement, and the adapters 296 are, in turn, threadedly engaged to corresponding openings in the end of the bus 290. In all alternative embodiment, the adapters 296 are optional.

EPDM rubber insulation, for example, may surround the conductive bus 290, the adapters 296 and may define interfaces that receive male connectors 182, 183 (FIGS. 2-4) or 242 and 243 (FIGS. 5-7). Ground shields 298 may be provided on the outer surfaces of the housings 281, 282, and 283 as desired.

While the assembly 280 is formed into a U-shaped configuration having substantially equal legs in one embodiment as shown in FIG. 8, it is appreciated that the connector assembly 280 may be alternatively shaped in other embodiments while still providing the load breaking functionality of the present invention. For example, the housings 281, 282 may be unequal in size, shape and dimension such as length, and the housings 281, 282 need not extend from the bus 290 at right angles in other embodiments.

Notably, and unlike the prior connector assemblies 164 (FIGS. 2-4) or 224 (FIGS. 5-7), the assembly 280 is an energized break connector that is configured for making and breaking an energized electrical connection, but is not a loadbreak connector designed for making and breaking an energized connection under load current. That is, the assembly 280 is configured for making and breaking an energized connection that is not under a normal load current. The lack of substantial current flow in such a condition generally results in no arcing when the contact probes 212, 214 are engaged to mating connectors. Nonetheless, the assembly 280 could be used with any of the aforementioned positioning or actuating elements and mechanisms to make or break electrical connections in more than one location in a cost effective manner.

While the invention has been described in terms of various specific embodiments, those skilled in the art will recognize that the invention can be practiced with modification within the spirit and scope of the claims.

What is claimed is:

1. An energized connector system, comprising:

first and second mating connectors positionable relative to one another from a connected position to a disconnected position to thereby break an electrical connection under energized circuit conditions; and an actuating element configured to move the first and second mating connectors from the connected position to the disconnected position by moving the first mating connector relative to the second mating connector, the actuating element comprising telescoping members that extend relative to one another when the first and second mating connectors are moved from the connected position to the disconnected position, wherein substantially all arc energy generated during the disconnecting of the electrical connectors is maintained within the first and second mating connectors.

2. The system of claim 1, wherein the actuating element is configured to move the first mating connector not more than a predetermined distance from the second mating connector.

3. The system of claim 1, wherein the actuating element comprises a stored energy element, wherein energy released from the stored energy element causes the first mating connector to move relative to the second mating connector.

4. The system of claim 1, further comprising:

a rail; and a housing member coupled to the first mating connector, the housing member being slidably positionable along the rail, wherein the actuating element moves the housing member along the rail to cause the first mating connector to move relative to the second mating connector.

5. The system of claim 1, wherein at least one of the first and second mating connectors comprises a deadfront connector.

6. The system of claim 1, wherein the first mating connector comprises:

an elastomeric housing; and a grounded conductive shield disposed around at least a portion of the elastomeric housing.

7. The system of claim 1, wherein the first and second mating connectors are positionable relative to one another from the connected position to the disconnected position to thereby break the electrical connection under loadbreak conditions.

8. The system of claim 1, wherein the actuating element comprises a release element, and wherein movement of at least a portion of the release element from a first position to a second position causes the actuating element to move the first and second mating connectors from the connected position to the disconnected position.

9. The system of claim 8, wherein the release element maintains the first and second mating connector pairs in the connected position until the portion of the release element is moved to the second position.

10. An energized connector system, comprising:

first and second mating connector pairs positionable relative to one another from a connected position to a disconnected position to thereby break an electrical connection under energized circuit conditions; and an actuating element configured to position the first and second mating connector pairs from the connected position to the disconnected position by moving the first mating connector pair relative to the second mating connector pair, the actuating element comprising telescoping members that extend relative to one another when the first and second mating connector pairs are moved from the connected position to the disconnected position, wherein substantially all arc energy generated during the disconnecting of the electrical connector pairs is maintained within the first and second mating connectors.

11. The system of claim 10, wherein the actuating element is configured to move the first mating connector pair not more than a predetermined distance from the second mating connector pair.

12. The system of claim 10, wherein the actuating element comprises a stored energy element, wherein energy released from the stored energy element causes the first mating connector pair to move relative to the second mating connector pair.

13. The system of claim 10, further comprising:

a rail; and a housing member coupled to the first mating connector pair, the housing member being slidably positionable along the rail, wherein the actuating element moves the housing member along the rail to cause the first mating connector pair to move relative to the second mating connector pair.

14. The system of claim 10, wherein at least one of the first and second mating connector pairs comprises a deadfront connector.

15. The system of claim 10, wherein the first mating connector pair comprises:

an elastomeric housing; and a grounded conductive shield disposed around at least a portion of the elastomeric housing.

16. The system of claim 10, wherein the first and second mating connector pairs are positionable relative to one another from the connected position to the disconnected position to thereby break the electrical connection under loadbreak conditions.

17. The system of claim 10, wherein the actuating element comprises a release element, and wherein movement of at least a portion of the release element from a first position to a second position causes the actuating element to move the first and second mating connector pairs from the connected position to the disconnected position.

18. The system of claim 17, wherein the release element maintains the first and second mating connector pairs in the connected position until the portion of the release element is moved from the first position to the second position.

19. An energized connector system, comprising:

first and second mating connectors positionable relative to one another from a connected position to a disconnected position to thereby break an electrical connection under energized circuit conditions; and an actuating element configured to move the first and second mating connectors from the connected position to the disconnected position by moving the first mating connector relative to the second mating connector, the actuating element comprising a release element, wherein movement of at least a portion of the release element from a first position to a second position causes the actuating element to move the first and second mating connectors from the connected position to the disconnected position, and wherein substantially all arc energy generated during the disconnecting of the electrical connectors is maintained within the first and second mating connectors.

20. The system of claim 19, wherein the actuating element is configured to move the first mating connector not more than a predetermined distance from the second mating connector.

21. The system of claim 19, wherein the release element maintains the first and second mating connector pairs in the connected position until the portion of the release element is moved to the second position.

22. The system of claim 19, further comprising:

a rail; and a housing member coupled to the first mating connector, the housing member being slidably positionable along the rail, wherein the actuating element moves the housing member along the rail to cause the first mating connector to move relative to the second mating connector.

23. The system of claim 19, wherein at least one of the first and second mating connectors comprises a deadfront connector.

24. The system of claim 19, wherein the first mating connector comprises:

an elastomeric housing; and a grounded conductive shield disposed around at least a portion of the elastomeric housing.

25. The system of claim 19, wherein the first and second mating connectors are positionable relative to one another from the connected position to the disconnected position to thereby break the electrical connection under loadbreak conditions.

26. An energized connector system, comprising:

first and second mating connector pairs positionable relative to one another from a connected position to a disconnected position to thereby break an electrical connection under energized circuit conditions; and an actuating element configured to position the first and second mating connector pairs from the connected position to the disconnected position by moving the first mating connector pair relative to the second mating connector pair, the actuating element comprising a release element, wherein movement of at least a portion of the release element from a first position to a second position causes the actuating element to move the first and second mating connector pairs from the connected position to the disconnected position, and wherein substantially all arc energy generated during the disconnecting of the electrical connector pairs is maintained within the first and second mating connectors.

27. The system of claim 26, wherein the actuating element is configured to move the first mating connector pair not more than a predetermined distance from the second mating connector pair.

28. The system of claim 26, wherein the actuating element comprises a stored energy element, wherein energy released from the stored energy element causes the first mating connector pair to move relative to the second mating connector pair.

29. The system of claim 26, wherein the release element maintains the first and second mating connector pairs in the connected position until the portion of the release element is moved from the first position to the second position.

30. The system of claim 26, further comprising:

a rail; and a housing member coupled to the first mating connector pair, the housing member being slidably positionable along the rail, wherein the actuating element moves the housing member along the rail to cause the first mating connector pair to move relative to the second mating connector pair.

31. The system of claim 26, wherein at least one of the first and second mating connector pairs comprises a deadfront connector.

32. The system of claim 26, wherein the first mating connector pair comprises:

an elastomeric housing; and a grounded conductive shield disposed around at least a portion of the elastomeric housing.

33. The system of claim 26, wherein the first and second mating connector pairs are positionable relative to one another from the connected position to the disconnected position to thereby break the electrical connection under loadbreak conditions.

* * * * *